US010687680B1

(12) United States Patent
Even

(10) Patent No.: US 10,687,680 B1
(45) Date of Patent: Jun. 23, 2020

(54) HINGED SQUEEGEE

(71) Applicant: Avraham Even, Netanya (IL)

(72) Inventor: Avraham Even, Netanya (IL)

( * ) Notice: Subject to any disclaimer, the term of this patent is extended or adjusted under 35 U.S.C. 154(b) by 0 days.

(21) Appl. No.: 16/278,737

(22) Filed: Feb. 19, 2019

(51) Int. Cl.
*A47L 13/11* (2006.01)
*A47L 1/06* (2006.01)

(52) U.S. Cl.
CPC ..... *A47L 13/11* (2013.01); *A47L 1/06* (2013.01)

(58) Field of Classification Search
CPC .... A47L 1/06; A47L 1/15; A47L 13/11; B60S 3/045; B08B 1/001; B08B 1/005
USPC ..... 15/117, 121, 212, 235.7, 235.8, 236.01, 15/236.02, 236.05–236.09, 245, 245.1; D32/41
See application file for complete search history.

(56) References Cited

U.S. PATENT DOCUMENTS 4,381,575 A * 5/1983 Wendt ..... A47L 1/06 15/121
4,607,411 A * 8/1986 Lewis, Jr. ..... A46B 17/08 15/117
6,546,589 B1 * 4/2003 Job ..... A47J 43/288 15/143.1
2004/0058074 A1 * 3/2004 Varner ..... A47L 1/06 427/355
2007/0169302 A1 * 7/2007 Madhala ..... A47L 1/06 15/245

FOREIGN PATENT DOCUMENTS

| | | | |
|---|---|---|---|
| DE | 19543164 | * | 5/1997 |
| EP | 3061381 | * | 8/2016 |
| FR | 2437467 | * | 4/1980 |
| FR | 2789289 | * | 8/2000 |

* cited by examiner

*Primary Examiner* — Mark Spisich
(74) *Attorney, Agent, or Firm* — Mark M. Friedman

(57) ABSTRACT

A squeegee comprising a wiping blade comprising a resilient strip supported by a relatively rigid support structure, said support structure having a first portion supporting a first part of said resilient strip and a second portion supporting a second part of said resilient strip; and a handle arrangement comprising a first handle portion rigidly attached to or integrally formed with said first portion of said support structure and a second handle portion rigidly attached to or integrally formed with said second portion of said support structure, said handle arrangement having an extensional direction perpendicular to a length of the wiping blade, said first and second handle portions being hingedly interconnected so as to define a pivot axis parallel to said extensional direction, pivotal motion of said first handle portion relative to said second handle portion about said pivot axis resulting in reconfiguration of said wiping blade from a straight state to a folded state.

13 Claims, 5 Drawing Sheets

HINGED SQUEEGEE

TECHNICAL FIELD

The presently disclosed subject matter relates to a squeegee, and, more particularly, to a hinged squeegee.

BACKGROUND

Squeegees are well known in the art and typically used for cleaning planar surfaces such as windows, minors, bench tops, floors, etc. The typical squeegee is comprised of a flexible wiping blade joined to a rigid elongated handle. Some types of squeegees are particularly adapted for cleaning flat horizontal surfaces such as countertops or table tops. These squeegees typically are smaller and lighter than window squeegees, with a relatively short blade and proportionally sized handle. These squeegees are typically operated with one hand.

One drawback with the known countertop squeegee, however, is that it is typically useful only for wiping excess liquid into a sink, while countertops typically also have solid waste material that require disposal into a trash bin, such as remnants of food, packaging, etc. These squeegees are not well suited for picking up solid waste objects for disposal into a trash bin.

SUMMARY

According to a first aspect of the presently disclosed subject matter there is provided a squeegee including a wiping blade made of a resilient strip supported by a relatively rigid support structure, the support structure having a first portion supporting a first part of the resilient strip and a second portion supporting a second part of the resilient strip; and a handle arrangement including a first handle portion rigidly attached to or integrally formed with the first portion of the support structure and a second handle portion rigidly attached to or integrally formed with the second portion of the support structure, the handle arrangement having an extensional direction perpendicular to a length of the wiping blade, the first and second handle portions being hingedly interconnected so as to define a pivot axis parallel to the extensional direction, pivotal motion of the first handle portion relative to the second handle portion about the pivot axis resulting in reconfiguration of the wiping blade from a straight state to a folded state.

According to another aspect of the presently disclosed subject matter there is provided a squeegee including a wiping blade made of a resilient strip integrally formed with, or attached to, a relatively rigid support structure, the support structure having a first portion supporting a first part of the resilient strip and a second portion supporting a second part of the resilient strip, the first and second portions being hingedly interconnected so as to define therebetween a pivot axis perpendicular to the wiping blade, pivotal motion of the first portion relative to the second portion about the pivot axis resulting in reconfiguration of the wiping blade from a straight state to a folded state.

According to some aspects the wiping blade is made of a continuous resilient strip. According to some aspects the wiping blade is integrally formed with the support structure. According to some aspects the wiping blade, the first and second portions, and the hinged interconnection are all integrally formed from a unitary block of elastomeric material. According to some aspects one or more integrally formed protrusions extend outward from the support structure.

BRIEF DESCRIPTION OF THE DRAWINGS

In order to understand the invention and to see how it can be carried out in practice, embodiments will be described, by way of non-limiting examples, with reference to the accompanying drawings, in which.

DETAILED DESCRIPTION

In the following detailed description, numerous specific details are set forth in order to provide a thorough understanding of the invention. However, it will be understood by those skilled in the art that the presently disclosed subject matter may be practiced without these specific details. In other instances, well-known methods, procedures, and components have not been described in detail so as not to obscure the presently disclosed subject matter.

Figure 1A:
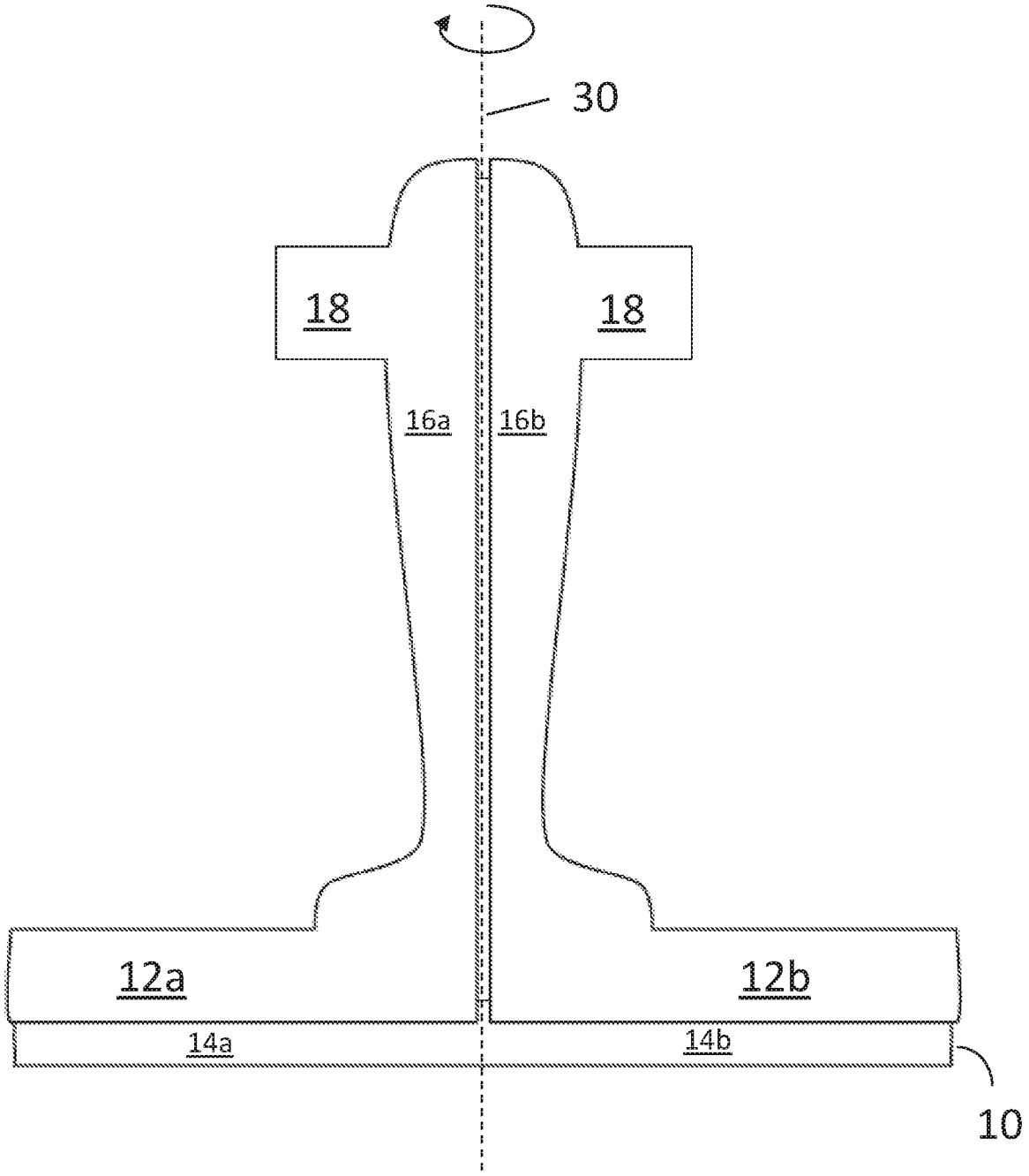
FIG. 1A illustrates an isometric view of a hinged squeegee in a straight state according to a first embodiment of the presently disclosed subject matter.
Figure 1B:
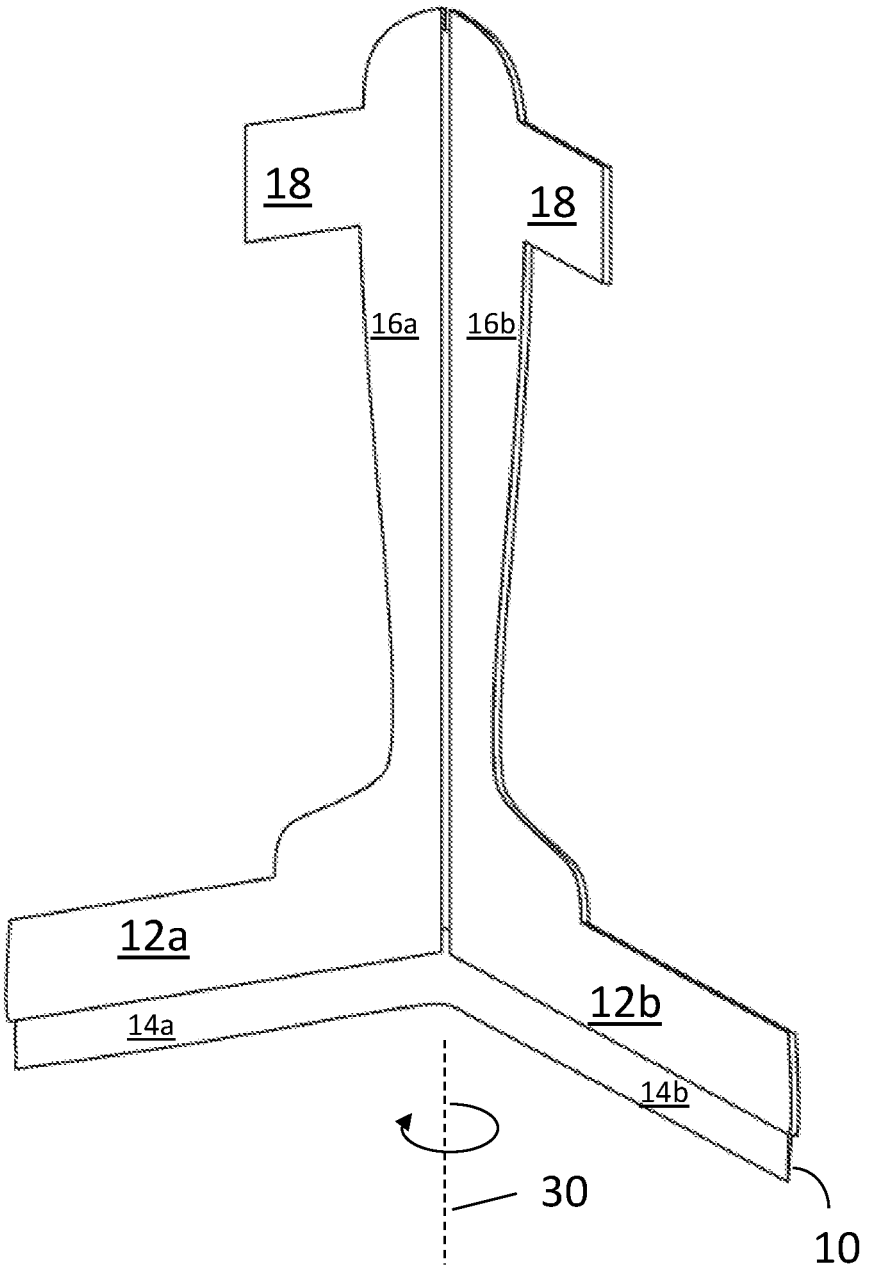
FIG. 1B illustrates an isometric view of a hinged squeegee in a folded state according to the embodiment of FIG. 1A.

Bearing this in mind, reference is now made to FIGS. 1A-1B, where there is illustrated an isometric view of a hinged squeegee according to a first exemplary embodiment of the presently disclosed subject matter. As shown in FIGS. 1A-1B, the squeegee includes a wiping blade 10 made of a resilient strip. The wiping blade 10 is supported by a relatively rigid support structure including a first portion 12*a* supporting a first part 14*a* of the resilient strip, and a second portion 12*b* supporting a second part 14*b* of the resilient strip. In a particularly preferred embodiment the wiping blade 10 is elongated and made of a continuous resilient strip, although in other embodiments the resilient strip can be formed from two or more strips joined together.

The squeegee further includes a handle arrangement, with an extensional direction perpendicular to a length of the wiping blade 10 (for example the length of the wiping edge of the blade). The handle arrangement includes a first handle portion 16*a* rigidly attached to or integrally formed with the first portion 12*a* of the support structure, and a second handle portion 16*b* rigidly attached to or integrally formed with the second portion 12*b* of the support structure. The first and second handle portions 16*a*, 16*b* are hingedly interconnected so as to define a pivot axis 30 parallel to the extensional direction of the handle arrangement, such that the pivotal motion of the first handle portion 16*a* relative to the second handle portion 16*b* (or vice versa) about the pivot axis 30 results in reconfiguration of the wiping blade 10 from a straight state to a folded state, whereby the wiping blade 10 is folded along a pivot axis parallel to the extensional direction of the handle arrangement.

For greater clarification FIG. 1A shows the squeegee in the straight state. In this state, blade 10 is straight and can be used for wiping liquids similarly to the squeegees known in the art. A user can operate the squeegee with one hand by pulling the squeegee across a countertop surface. When the blade encounters solid waste objects, such as remnants of food, peels, packaging, dough, etc., the user can, usually with one hand (for example with the index finger behind first handle portion 16*a* and thumb and pinky finger on opposing sides of second handle portion 16*b*), manipulate the handle arrangement by pivoting the first handle portion 16*a* relative to the second handle portion 16*b* (or vice versa) so as to reconfigure the blade 10 into a folded state, as shown in FIG. 1B.

As shown in FIG. 1B, in a folded state, which should be understood to include a plurality of folded states, each with a different degree of folding, the squeegee can now be used to grasp solid object(s) between the first part 14*a* and second part 14*b* of the resilient strip without lifting the wiping blade from the countertop or other surface being wiped. That is, the user can now use the squeegee to grasp the solid waste between the ends of the now folded wiping blade, lifting the waste off the counter releasing it into the trash bin.

It should be appreciated that "hingedly interconnected" can include, for example where the handle portions are connected via integral hinge(s) or a mechanical hinge, and that such a hinge may have spring-like properties which force the squeegee into a straight state by default (i.e. in the absence of any pivotal motion by the user). In other embodiments, the resilient property of the strip of the wiping blade strip can force the wiping blade to a default straight state. In still other embodiments, the squeegee may further include a spring (not shown) or similar mechanism to automatically return the wiping blade to a straight state.

In certain embodiments, one or both of first and second handle portions 16*a*, 16*b* can optionally include one or more protrusions 18 extending outward from the handle portion (s), e.g. in a direction perpendicular to, or at an angle relative to, the extensional direction of the handle arrangement, further allowing a user to grasp and pivot the first and/or second handle portion to bring the wiping blade into a folded state.

In certain embodiment, the handle arrangement can have an extensional direction other than perpendicular to the length of the wiping blade. For example, the handle arrangement can be angled relative to the length of the wiping blade.

In a most particularly preferred embodiment, the support structure and handle portions are all integrally molded with an integral hinge, in order to simplify the manufacturing process, possibly using overmolding to integrate the resilient strip.

Figure 2A:
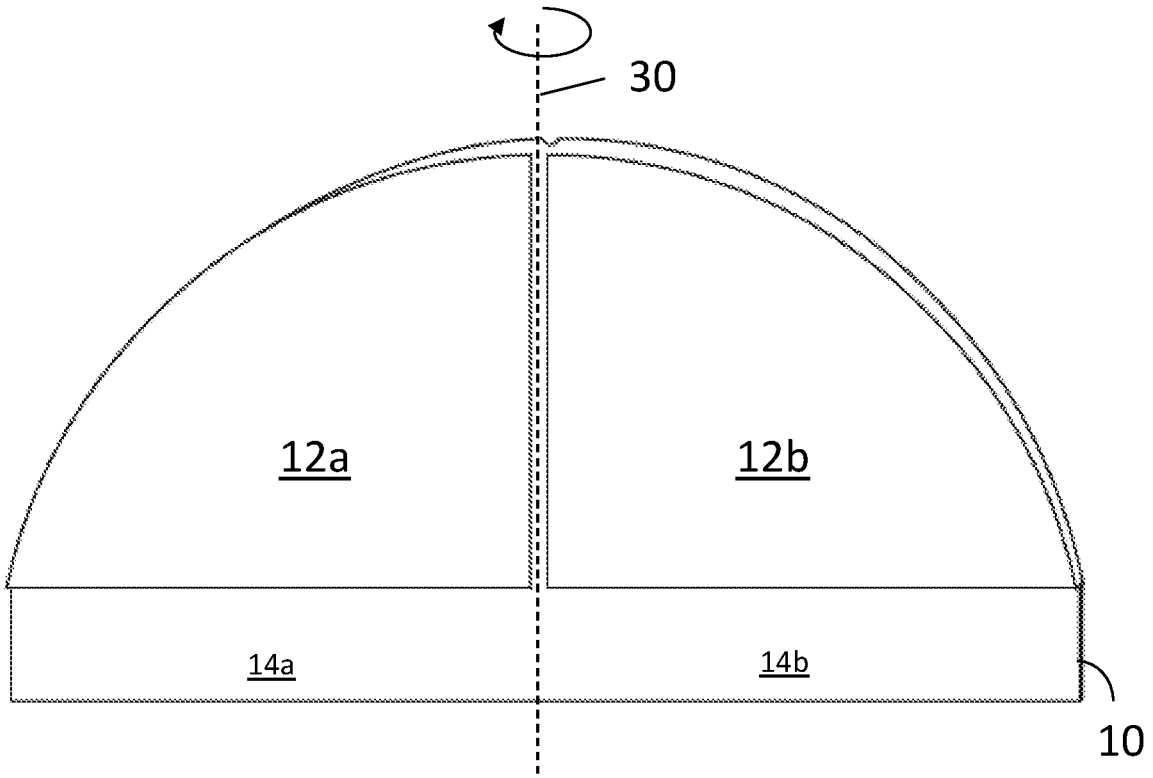
FIG. 2A illustrates an isometric view of a hinged squeegee in a straight state according to a second embodiment of the presently disclosed subject matter.
Figure 2B:
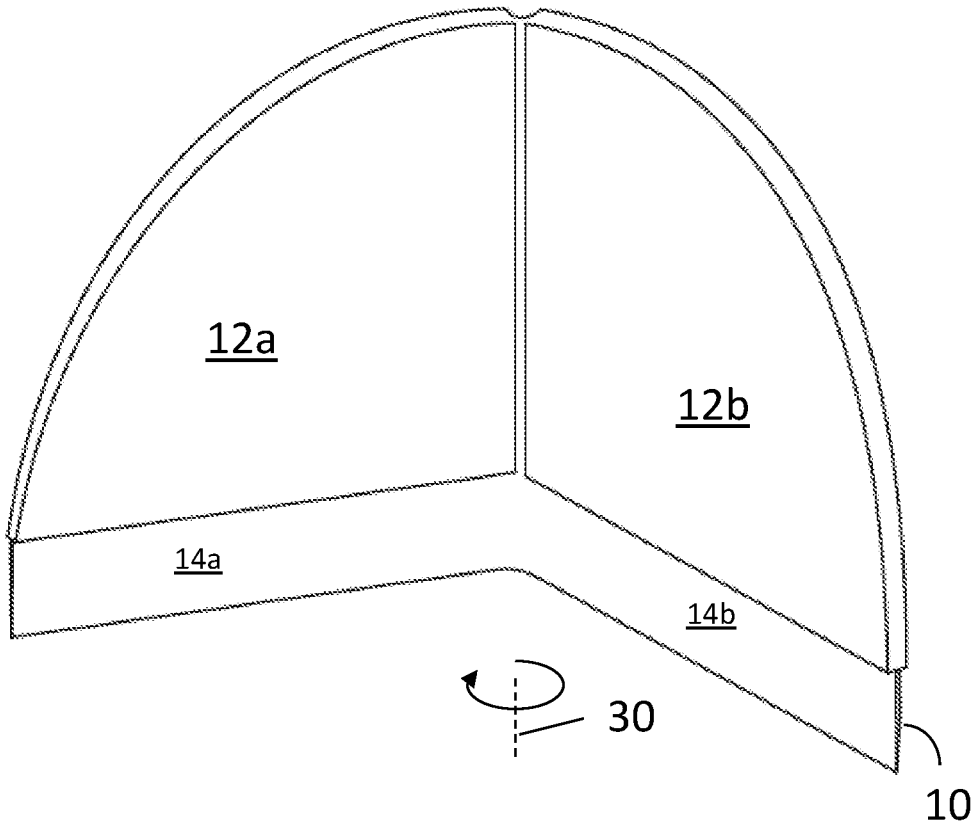
FIG. 2B illustrates an isometric view of a hinged squeegee in a folded state according to the embodiment of FIG. 2A.

Reference is now made to FIGS. 2A-2B, where there is illustrated an isometric view of a hinged squeegee according to a second exemplary embodiment. The wiping blade 10 made of a resilient strip can be integrally formed with, or attached to, the support structure, the support structure being relatively rigid relative to the wiping blade 10. Similar to the embodiment shown in FIGS. 1A-1B, the support structure includes a first portion 12*a* supporting a first part 14*a* of the resilient strip, and a second portion 12*b* supporting a second part 14*b* of the resilient strip. The first and second portions 12*a*, 12*b* are hingedly interconnected so as to define therebetween a pivot axis 30 perpendicular to the length of the wiping blade 10 (for example the length of the wiping edge of the blade), and in which a pivotal motion of the first portion 12*a* relative to the second portion 12*b* (or vice versa) about the pivot axis 30 results in reconfiguration of the wiping blade 10 from a straight state as shown in FIG. 2A, to a folded state as shown in FIG. 2B. In a particularly preferred embodiment, the squeegee is made from a unitary block of elastomeric material such as plastic or silicone. The hinged interconnection is preferably also integrally formed from the unitary block of elastomeric material.

The phrase "relatively rigid" is used herein in the specification and claims to contrast to the flexibility required by a wiping blade structure, and refers to any structure which provides sufficient rigidity of support to allow the blade to be pressed evenly in sealing contact with an underlying surface. The support structure is "relatively rigid" in that it is more rigid than the blade. The rigidity may be imparted either through choice of a relatively rigid material, such as various thermoplastics, or by varying the relative dimensions and/or cross-sectional shape to provide the desired level of rigidity.

In certain embodiments, the unitary block of elastomeric material is thicker at the support structure than the blade, as shown in FIGS. 2A-2B. This can provide the required level of rigidity in the support structure to support both wiping a surface and folding the blade. In certain embodiments, the blade can be roughly flush with one surface of the support structure. In certain embodiments, the hinged interconnection can be closer to the front surface than the back surface of the support structure in order to allow folding in the direction of wiping.

Figure 2C:
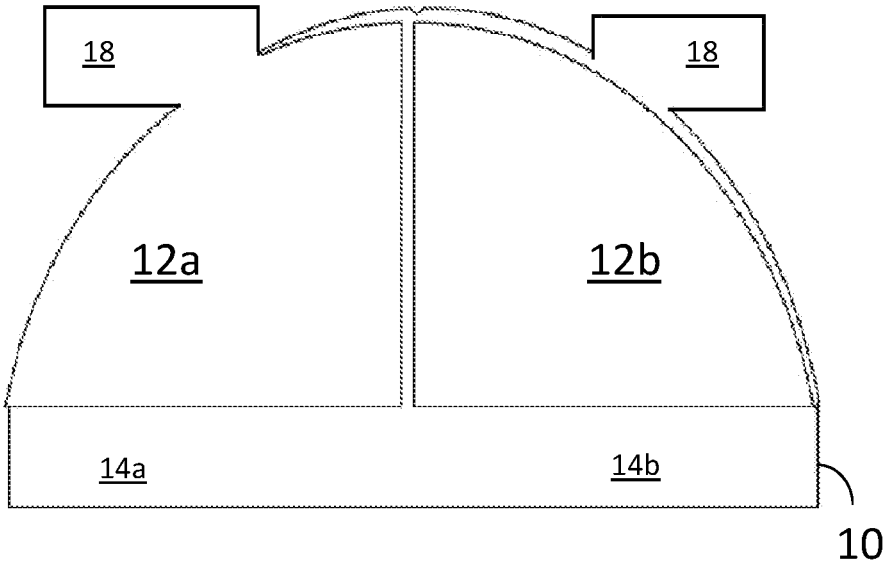
FIG. 2C illustrates another embodiment of the squeegee according to the second embodiment.

The embodiment shown in FIGS. 2A-2B can be operated in the same manner as the embodiment shown in FIGS. 1A-1B. Optionally, as shown in FIG. 2C the support structure can further include integrally formed protrusions 18 extending outward from support structure, for example parallel to the blade, to make pivoting the support structure easier for the user.

Optionally, the first portion 12*a* of the support structure can include a first blade support portion (not shown) extending parallel to the first part 14*a* of the resilient strip and a first handle portion (not shown) integrally formed with the first blade support portion, and the second portion 12*b* of the support structure can include a second blade support portion (not shown) extending parallel to the second part 14*b* of the resilient strip and a second handle portion (not shown), integrally formed with the second blade support portion, both the first and second handle portions having an extensional direction parallel to the pivot axis 30.

In a particularly preferred embodiment the wiping blade 10 is elongated and made of a continuous resilient strip, although in other embodiments the resilient strip can be formed from two or more strips joined together.

Although the squeegees described above and with reference to FIGS. 1A-B and FIGS. 2A-B have been described as countertop squeegees, the described features and principles of operation can also be applied to larger squeegees such as floor squeegees.

It is to be understood that the invention is not limited in its application to the details set forth in the description contained herein or illustrated in the drawings. The invention is capable of other embodiments and of being practiced and carried out in various ways. Hence, it is to be understood that the phraseology and terminology employed herein are for the purpose of description and should not be regarded as limiting. As such, those skilled in the art will appreciate that the conception upon which this disclosure is based may readily be utilized as a basis for designing other structures, methods, and systems for carrying out the several purposes of the presently disclosed subject matter.

Those skilled in the art will readily appreciate that various modifications and changes can be applied to the embodiments of the invention as hereinbefore described without departing from its scope, defined in and by the appended claims.

The invention claimed is:

1. A squeegee comprising:

a wiping blade comprising a resilient strip supported by a relatively rigid support structure, said support structure having a first portion supporting a first part of said resilient strip and a second portion supporting a second part of said resilient strip; and a handle arrangement comprising a first handle portion rigidly attached to or integrally formed with said first portion of said support structure and a second handle portion rigidly attached to or integrally formed with said second portion of said support structure, said handle arrangement having an extensional direction perpendicular to a length of the wiping blade, said first and second handle portions being hingedly interconnected so as to define a pivot axis parallel to said extensional direction, pivotal motion of said first handle portion relative to said second handle portion about said pivot axis resulting in reconfiguration of said wiping blade from a straight state to a folded state.

2. The squeegee of claim 1, wherein the wiping blade is made of a continuous resilient strip.

3. The squeegee of claim 1, wherein in a folded state, the squeegee is configured to pick up objects.

4. The squeegee of claim 1, wherein a release of said pivotal motion results in a reconfiguration of said wiping blade from a folded state to a straight state.

5. The squeegee of claim 1, further comprising one or more protrusions extending outward from the handle arrangement.

6. A squeegee comprising:

a wiping blade comprising a resilient strip integrally formed with a relatively rigid support structure, said support structure having a first portion supporting a first part of said resilient strip and a second portion supporting a second part of said resilient strip, said first and second portions being hingedly interconnected so as to define there between a pivot axis perpendicular to the wiping blade, pivotal motion of said first portion relative to said second portion about said pivot axis resulting in reconfiguration of said wiping blade from a straight state to a folded state, wherein said hinged interconnection is integrally formed with said wiping blade and said support structure.

7. The squeegee of claim 6, wherein the wiping blade is made of a continuous resilient strip.

8. The squeegee of claim 6, wherein said wiping blade, said first and second portions, and said hinged interconnection are all integrally formed from a unitary block of elastomeric material.

9. The squeegee of claim 8, wherein the block of elastomeric material is thicker at the support structure relative to the blade.

10. The squeegee of claim 6, wherein in said hinged interconnection facilitates a folding of the support structure in a manner suitable for picking up objects with said squeegee.

11. The squeegee of claim 6, wherein a release of said pivotal motion results in a reconfiguration of said wiping blade from a folded state to a straight state.

12. The squeegee of claim 6, further comprising one or more integrally formed protrusions extending outward from support structure.

13. A squeegee comprising:

a wiping blade comprising a resilient strip integrally formed with, or attached to, a relatively rigid support structure, said support structure having a first portion supporting a first part of said resilient strip and a second portion supporting a second part of said resilient strip, said first and second portions being hingedly interconnected so as to define there between a pivot axis perpendicular to the wiping blade, pivotal motion of said first portion relative to said second portion about said pivot axis resulting in reconfiguration of said wiping blade from a straight state to a folded state, wherein said first portion of said support structure includes a first blade support portion extending parallel to said first part of said resilient strip and a first handle portion, integrally formed with said first blade support portion, and wherein said second portion of said support structure includes a second blade support portion extending parallel to said second part of said resilient strip and a second handle portion, integrally formed with said second blade support portion, said first and second handle portions having an extensional direction parallel to said pivot axis.

* * * * *